US007789612B2

(12) United States Patent
Milani et al.

(10) Patent No.: US 7,789,612 B2
(45) Date of Patent: Sep. 7, 2010

(54) APPARATUS AND METHOD FOR THE DISPOSAL OF WASTE

(76) Inventors: Thomas Milani, P.O. Box 157, Bethel Park, PA (US) 15102; Stephen V. Milani, P.O. Box 157, Bethel Park, PA (US) 15102

( * ) Notice: Subject to any disclaimer, the term of this patent is extended or adjusted under 35 U.S.C. 154(b) by 1242 days.

(21) Appl. No.: 11/353,409

(22) Filed: Feb. 14, 2006

(65) Prior Publication Data

US 2006/0245892 A1 Nov. 2, 2006

Related U.S. Application Data

(60) Provisional application No. 60/660,789, filed on Mar. 11, 2005.

(51) Int. Cl.
*B66F 9/18* (2006.01)

(52) U.S. Cl. ..... 414/620; 414/607; 414/608; 187/237

(58) Field of Classification Search ..... 414/607, 414/608, 620, 621; 187/237
See application file for complete search history.

(56) References Cited

U.S. PATENT DOCUMENTS

| | | | | | |
|---|---|---|---|---|---|
| 2,005,221 | A | * | 6/1935 | Cohen et al. | 52/413 |
| 3,203,567 | A | * | 8/1965 | Huitfeldt | 414/620 |
| 3,203,568 | A | * | 8/1965 | Quayle | 414/621 |
| 3,223,267 | A | * | 12/1965 | Stammen | 414/671 |
| 3,482,722 | A | * | 12/1969 | Simovich | 414/641 |
| 3,484,851 | A | * | 12/1969 | Esser et al. | 414/667 |
| 3,762,586 | A | | 10/1973 | Updike, Jr. | |
| 4,095,714 | A | * | 6/1978 | Schuster | 414/607 |
| 4,396,341 | A | | 8/1983 | Brouwer et al. | |
| 5,114,297 | A | | 5/1992 | Kirchhoff | |
| 5,374,156 | A | * | 12/1994 | Simpson et al. | 414/667 |
| 5,549,437 | A | | 8/1996 | Kishi | |
| 5,669,750 | A | * | 9/1997 | Vieselmeyer | 414/722 |
| D425,528 | S | | 5/2000 | Lindgren et al. | |
| D430,965 | S | | 9/2000 | Koberlein | |
| 6,572,322 | B2 | | 6/2003 | Karr | |
| 6,644,906 | B2 | | 11/2003 | Bayne | |
| 6,655,900 | B1 | * | 12/2003 | Knutson | 414/729 |
| 7,074,004 | B2 | * | 7/2006 | Lockamy et al. | 414/549 |
| 2002/0154973 | A1 | | 10/2002 | Bradshaw et al. | |
| 2002/0159870 | A1 | | 10/2002 | Pruteanu et al. | |

* cited by examiner

*Primary Examiner*—Michael S Lowe
(74) *Attorney, Agent, or Firm*—McKay & Associates, P.C.

(57) ABSTRACT

The present invention comprehends a forklift attachment, generally comprising a pair of forks rotatably mounted to a fork plate using a pair of pivot pins with each pivot pin having a center axis normal to the fork plate. Upper bore pins and lower bore pins are adapted to travel within bores of the fork plate. As such, actuators connected to the upper bore pin rotate the forks about the center axis such that the forks can apply opposing lateral compression forces to a flexible dumpster. In a method for collecting waste, a disposer places the flexible dumpster near the waste disposal site whereby a truck-mounted forklift can be utilized to engage the forks with the side portions of the flexible dumpster for loading and disposal. Accordingly, large dumpsters do not have to dropped off at the waste disposal site and large trucks no longer have to be utilized.

15 Claims, 5 Drawing Sheets

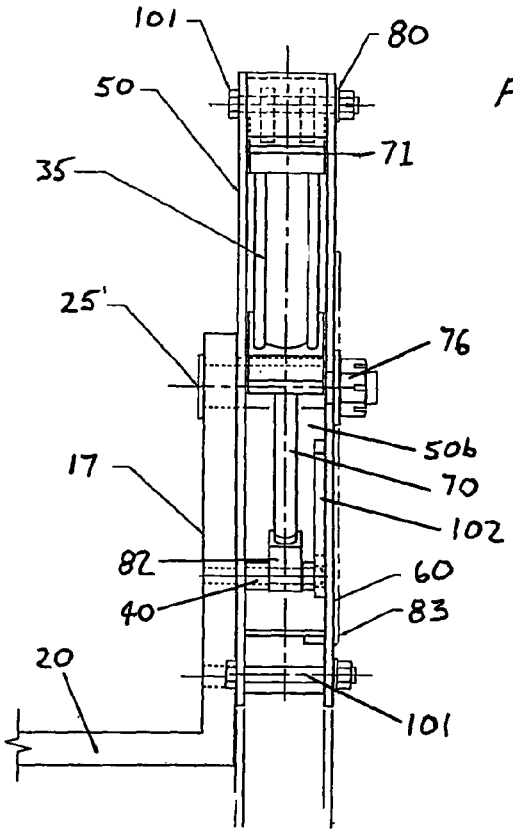
FIG. 7
FIG. 8
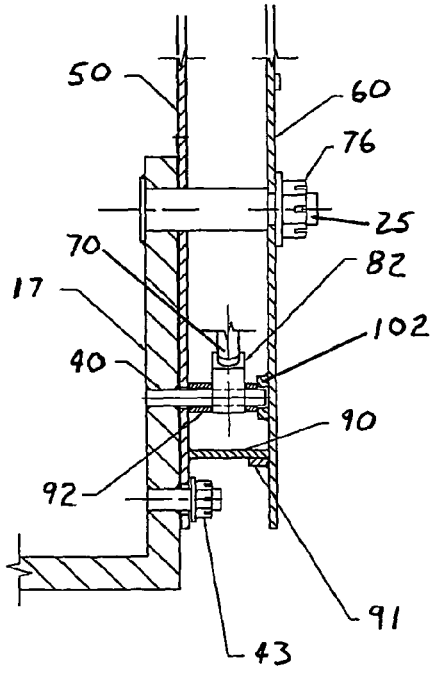

APPARATUS AND METHOD FOR THE DISPOSAL OF WASTE

SPECIFIC REFERENCE

The present application hereby claims benefit of provisional application Ser. No. 60/660,789, filed Mar. 11, 2005.

FIELD OF THE INVENTION

The present invention relates generally to a forklift attachment and method of using the same to lift a flexible dumpster, and particularly relates to a forklift lifting mechanism wherein the forks are adapted to rotatably pivot counterclockwise or clockwise to provide lateral compression forces against the flexible dumpsters for retrieval and disposal, which results in more efficient methods for disposing of waste.

BACKGROUND

Heavy steel dumpsters are the present state of the art in the waste disposal industry. A waste disposer calls the waste disposal company in advance of the waste generation event to request a large, rigid dumpster. As an initial step then the waste disposal company delivers the dumpster to the location using a large waste disposal vehicle. The vehicle has a means for unloading and loading these heavy steel dumpsters. However, these large bins and waste disposal vehicles frequently cause damage to the disposer's property during dumpster delivery and pickup, and the process of loading and unloading such large, steel bins can be quite hazardous.

Another disadvantage of using a large waste disposal vehicle for dumpster drop off and retrieval is its restricted dumpster placement range. For example, a large vehicle would not be able to place a dumpster behind the disposer's home or at a site inaccessible from a nearby street without causing extensive damage to the disposer's property. Most likely, and as is common, the large waste disposal vehicle would be forced to place the dumpster near a street or roadway to avoid damage to the disposer's land. This dumpster placement is inconvenient for disposers since they have to move their waste from the disposal site to the dumpster placement area, and this further imposes a burden on vehicles using the street. The present invention overcomes these and other disadvantages of the prior art by providing a method and apparatus pertaining to a lightweight flexible dumpster and modified forklift attachment.

SUMMARY OF THE INVENTION

The object of the present invention is to provide a forklift wherein its forks have a means for both vertical movement and rotatable/pivotable movement such that lateral compression forces can be applied to flexible dumpsters for retrieval and hauling.

Yet another object of the present invention is to provide a truck-mounted forklift and flexible dumpster system in order to prevent destruction of a disposer's property during dumpster retrieval.

Yet another advantage of the present system is to completely eliminate the step of requiring a dumpster to be dropped off by the waste disposal company.

Accordingly, what is provided is a forklift attachment generally comprising a pair of forks each having an upper portion and a lower portion. A fork plate has upper corners and lower corners and has defined therein a pair of upper bores and a pair of lower bores radially defined proximate to the lower corners. A mounting plate is connected to the fork plate to define an attachment interior. A pair of pivot pins each has a center axis normal to the fork plate and rotatably connects tops of the upper portions to the fork plate. A pair of lower bore pins each connect bottoms of the upper portions of the forks to the fork plate and are adapted to radially travel within one of the lower bores, about the center axis. A pair of upper bore pins connect the upper portions of the forks to the fork plate, with each upper bore pin adapted to radially travel within the upper bore about the center axis. A pair of actuators, each positioned behind the fork plate within the attachment interior have one end attached near one of the upper corners and another end attached to the upper bore pin, wherein upon actuation of the actuators, the upper bore pin can travel within the upper bore thereby rotating the forks about the center axis such that the forks can apply opposing lateral compression forces to a flexible dumpster.

Also, provided herein is a method for collecting waste using a modified truck-mounted forklift to allow for the utilization and hauling of a flexible dumpster, comprising the steps of, providing a flexible dumpster to a disposer, wherein the disposer places the flexible dumpster near the waste disposal site; unloading a truck-mounted forklift from a waste disposal vehicle; positioning the forklift within pickup range of the flexible dumpster; expanding pivotable forks in opposite directions of each other via at least one actuator; closing the pivotable forks via the actuator thereby engaging the forks with the side portions of the flexible dumpster, lifting the flexible dumpster utilizing the forklift's vertical movement, and loading the flexible dumpster onto the waste disposal vehicle, whereby large, rigid dumpsters do not have to be dropped off at the waste disposal site, and large trucks no longer have to be utilized.

BRIEF DESCRIPTION OF THE DRAWINGS

FIG. 7 shows a detailed side view of the forklift attachment.

FIG. 8 shows a cross-section side view of the forklift attachment.

DETAILED DESCRIPTION OF THE PREFERRED EMBODIMENT

Figure 1:
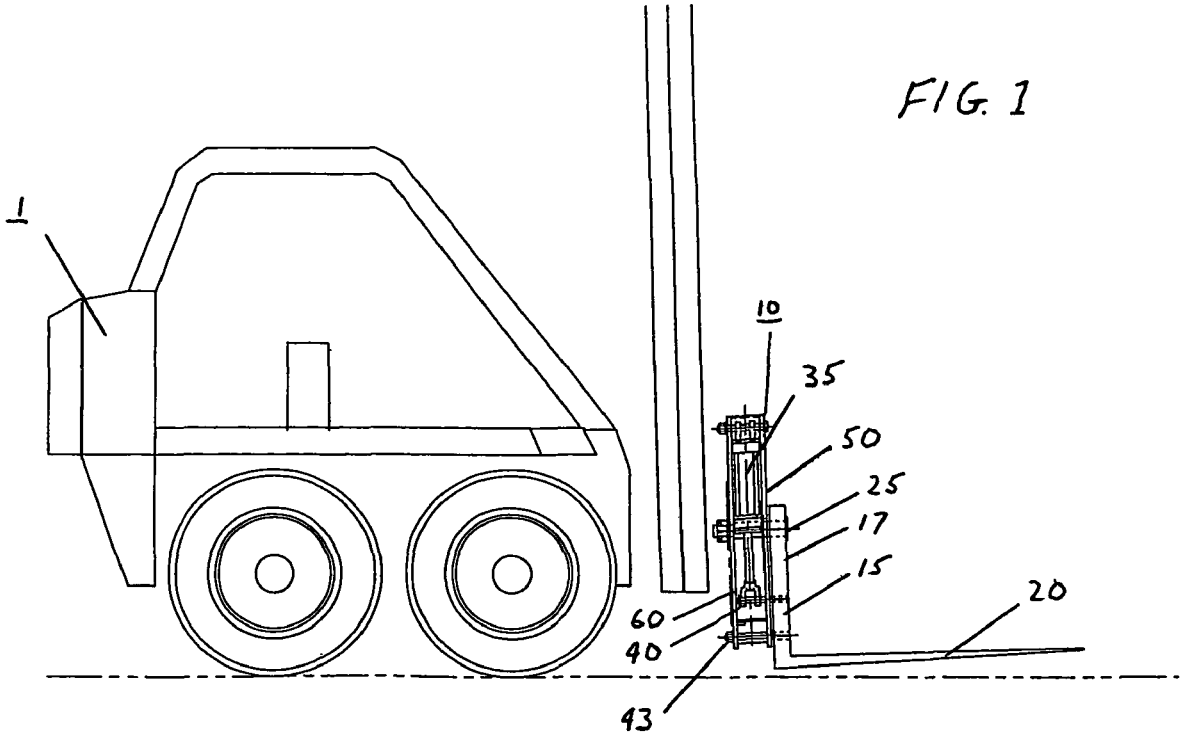
FIG. 1 illustrates a side view of a conventional forklift with a side view of the forklift attachment.
Figure 2:
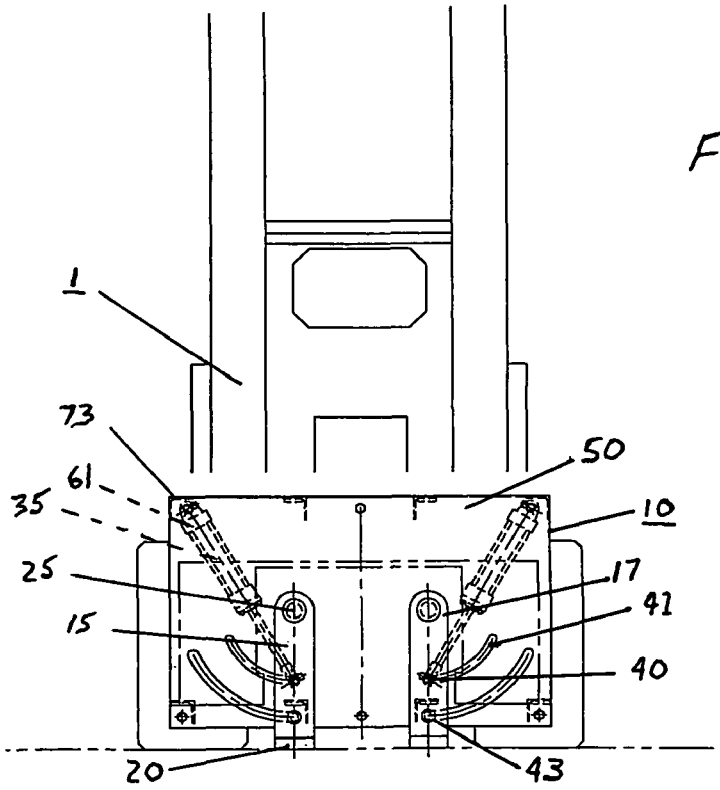
FIG. 2 illustrates a front view of the forklift attachment with the pivotable forks of the forklift attachment in the closed position.

The invention will now be described in detail in relation to a preferred embodiment and implementation thereof which is exemplary in nature and descriptively specific as disclosed. As is customary, it will be understood that no limitation of the scope of the invention is thereby intended. The invention encompasses such alterations and further modifications in the illustrated apparatus and method, and such further applications of the principles of the invention illustrated herein, as would normally occur to persons skilled in the art to which the invention relates. "A" as used in the claims means one or more.

As illustrated then with reference to FIGS. 1-9, a forklift attachment 10 is provided. This forklift attachment 10 is adapted for placement on a conventional forklift 1. This invention contemplates both a forklift attachment 10 and a conventional or truck-mounted forklift made integral with the attachment 10. It is also envisioned that the forklift can be mounted on a trailer for use. For purposes of this description, and not to limit the scope of the invention, the forklift attachment 10 will be referenced.

The forklift attachment 10 includes a pair of forks 15. The forks 15 are generally L-shaped and include an upper portion 17 and a lower portion 20. The lower portions 20 extend generally perpendicularly from the upper portions 17 and parallel to the ground, but they may also be slightly angled in either direction relative to the upper portions 17 or rotationally with respect to the ground. For example, the upper portions 17 may slope toward each other, thus forks 15 can be angled (not shown) to provide for improved pickup of a flexible dumpster and further to prevent the forks 15 from puncturing the flexible dumpster.

The forks 15 are mounted to a generally rectangular, fork plate 50 having upper corners 73 and lower corners 73*a*. Within the fork plate 50, a pair of slot-like upper bores 41 and a pair of lower bores 42 are defined radially therein about a center point of rotation for the forks 15, proximate to the lower corners 73*a*. This center point of rotation is formed using a pair of pivot pins 25. The pivot pin 25 has a center axis normal to the fork plate 50, rotatably connecting tops 15*a* of the upper portions 17 of the forks 15 to the fork plate 50. The pivot pin 25 is further secured using pin hex nut 76 to the back of the mounting plate 60. As such, the forks 15 are adapted to rotate or pivot clockwise or counterclockwise on the fork plate 50.

A pair of lower bore pins 43 connect bottoms 15*b* of the upper portions 17 of the forks 15 to the fork plate 50, for example by using a nut and screw or bolt fastened to the fork 15 through the fork plate 50. A similar type of fastening means may also be used which connects the fork 15 all the way to the mounting plate 60, provided there is an identically shaped lower bore defined within the mounting plate aligned with the lower bore 42 of the fork plate 50. The lower bore pins 43 are adapted to radially travel within the lower bores 42, about the center axis defined by the pivot pin 25 while holding the fork 15 in place. With this configuration then, the forks 15 can be kept aligned with the fork plate 50 upon rotation, with the limits of rotation or pivoting of the forks 15 fixed by the size of the lower bore 42.

A pair of upper bore pins 40 further connect the upper portions 17 of the forks 15 to the fork plate 50. Each upper bore pin 40 is preferably longer than the lower bore pin 43, situated against or directly to the mounting plate 60 so as to retain both the fork 15 and an actuator 35 in place, as further described. In one embodiment, each upper bore pin 40 will ride against a face plate 102 mounted on the mounting plate having a groove defined identically to each upper bore 41. The upper bore pin 40 may also travel within an identically sized bore of the mounting plate 60 if directly attached to the mounting plate 60. Each upper bore pin 40 is adapted to radially travel within each upper bore 41, about the center axis of the pivot pin 25. As shown, the upper bore 41 has a radial length smaller than the lower bore 42 since the upper bore 41 is positioned closer to the pivot pin 25 and thus the point of rotation. Some type of lubricant may be placed within each bore and/or on each pin to reduce friction and enable better wear.

A mounting plate 60 generally of similar size to the fork plate 50 is connected to the fork plate 50 by being bolted thereto using one or more shoulder bolts 101 and/or by using a support plate 90 and support plate tab 91. Specifically, a support plate tab 91 is perpendicularly formed on the mounting plate 60. Then, for added rigidity, the support plate 90 is perpendicularly situated over the support plate tab 91 with one edge welded to the mounting plate 60 and the other edge welded to the fork plate 50. With this configuration, an attachment interior 50*b* is defined between the mounting plate 60 and fork plate 50.

Each fork 15 is rotated by providing an actuator 35 positioned behind the fork plate 50 within the attachment interior 50*b*. The term actuator here covers any type of actuation, including but not limited to, mechanical, hydraulic, air or the like. The actuators 35 may also vary slightly in location. Basically, the actuator 35 has one end positioned near one of the upper corners 73 of the fork plate 50 (and similar sized, opposing corner of the mounting plate 60). The other end of the actuator 35 is connected to the upper bore pin 40, wherein upon actuation of the actuator 35, the upper bore pin 40 is drawn upwards and forced to travel along a path defined by the upper bore 41, thereby rotating or pivoting each fork 15.

More specifically and in one embodiment for the actuation means, the actuator 35 comprises a cylinder housing 71 having a housing top 71*a* and housing bottom 71*b*, wherein the housing top 71*a* is mounted on the shoulder bolt 101 behind and near the upper corner 73 of the fork plate 50. A hydraulic or pneumatic cylinder 35*a* is then situated within the cylinder housing 71. A shaft 70 movable by or within cylinder 35*a* has a shaft eye 82 formed on its lower end distal from the cylinder 35*a*. The shaft eye 82 allows the shaft 70 and thus the cylinder 35*a* to be connected to the upper bore pin 40. A longitudinal sleeve 92 may assist in retaining shaft eye 82 in place on upper bore pin 40. Thus, upon actuation of actuator 35, the upper bore pin 40 travels within the upper bore 41, thereby rotating the forks 15 about the center axis/pivot pin 25 such that the forks 15 can apply opposing lateral compression forces to, for example, a flexible dumpster 2.

Figure 3:
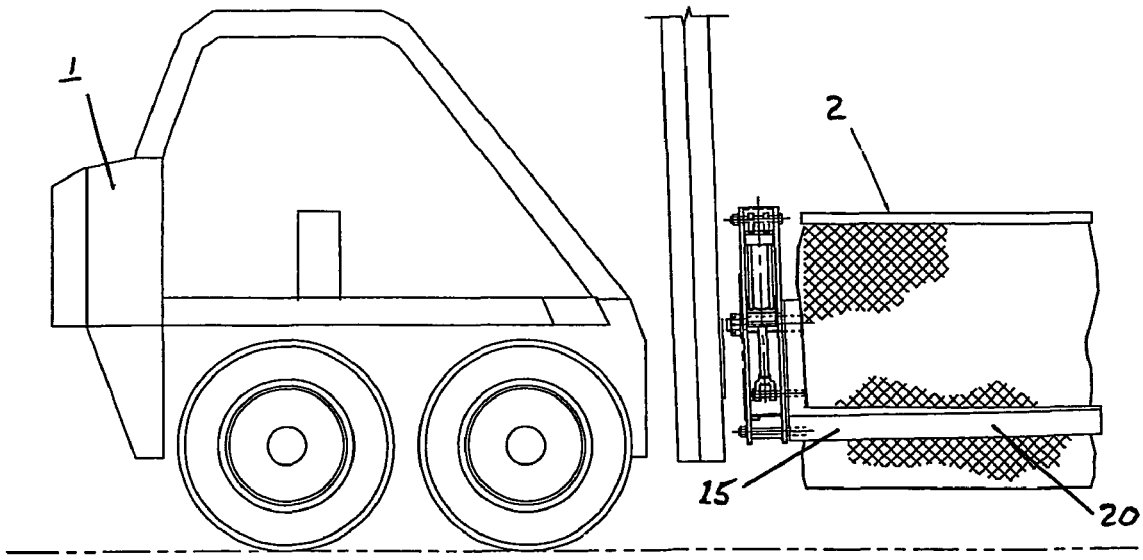
FIG. 3 illustrates a side view of the forklift and attachment being utilized to haul a flexible dumpster.
Figure 4:
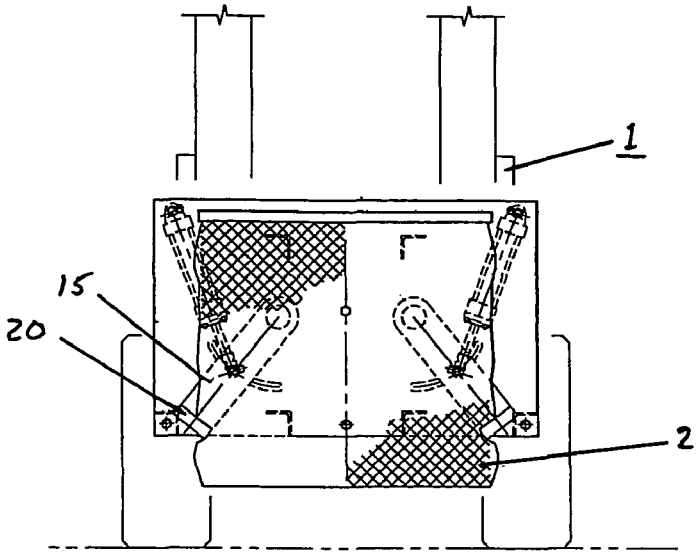
FIG. 4 illustrates a front view of the embodiment of FIG. 3 with the flexible dumpster.
Figure 5:
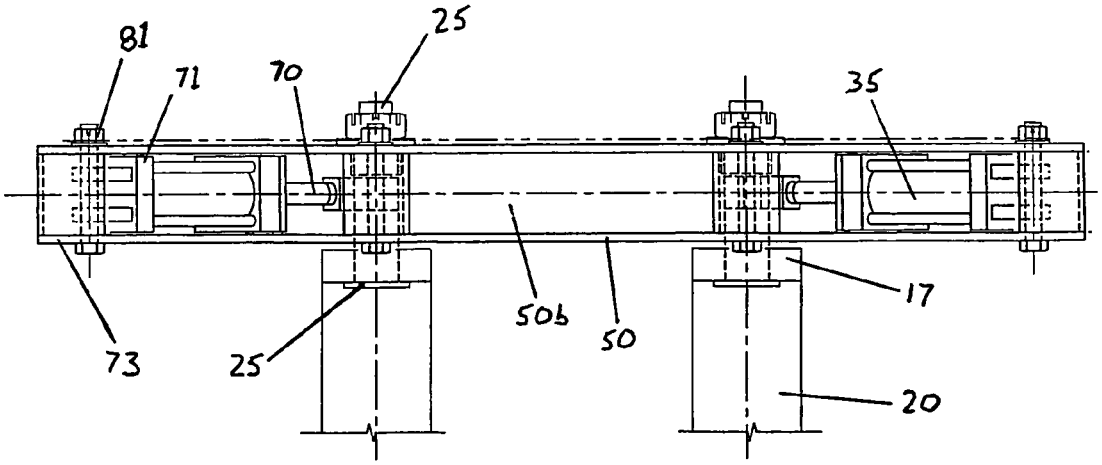
FIG. 5 illustrates a top view of the forklift attachment.
Figure 6:
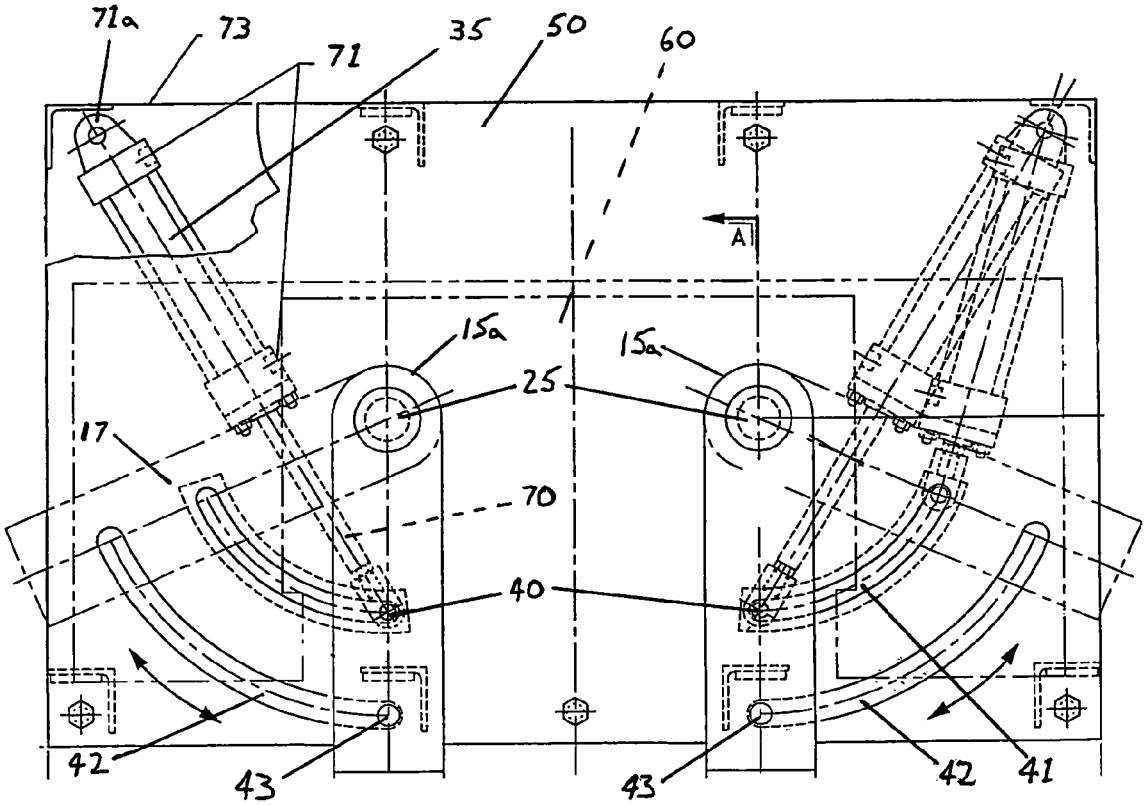
FIG. 6 shows a detailed front view of the forklift attachment.
Figure 9:
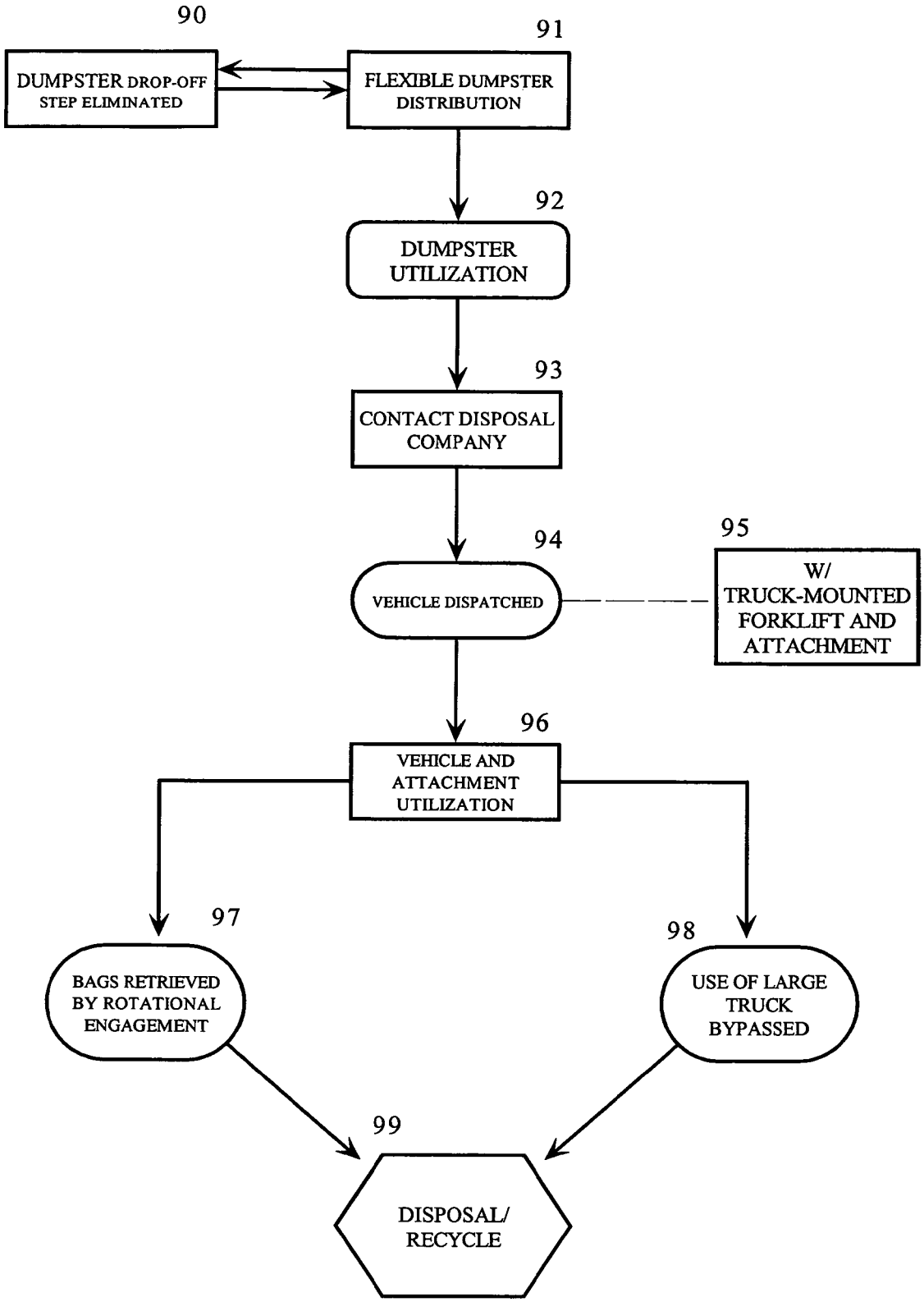
FIG. 9 is a flow chart representing a method of using the forklift and attachment to efficiently remove waste from a remote location.

Now referring to the method disclosed by the present invention and with reference to FIGS. 3, 4, and 9 specifically, with the discovery of the forklift attachment 10 described above, a method of utilizing a forklift 1 in an improved system of flexible dumpster 2 retrieval is further defined. This method of collecting waste first involves the distribution 91 or sale of lightweight flexible dumpsters 2 to the disposer in a retail-type setting. It is envisioned that hardware and construction supply stores in particular will sell these flexible dumpsters 2. The dumpsters will preferably be packaged in a flat vacuum sealed package. The flexible dumpsters, also known in the art as "bulk bags," are similar to the kind sold by the Alabama Bag Company. These products can hold a great deal of waste material because of their tightly woven fabric and strong tear-resistance. The flexible dumpsters can be disposable or alternatively be recyclable.

The flexible dumpster 2 has many advantages over the prior art conventional steel dumpster. For one, the flexible dumpster 2 does not require delivery to the disposer's site. As discussed above, the disposer will simply purchase as many flexible dumpsters as needed for the disposal. If the number of bags needed for a project is over-estimated, the surplus dumpsters can be returned to the retail store. Further, contractors or other waste disposers can easily place a flexible dumpster in their vehicle or toolbox for use when necessary. Secondly, the flexible dumpster can be placed at any location suitable for pickup with the truck-mounted forklift 1 with the forklift attachment 10. Thus, the disposer could for example place the dumpster 2 outside of a window of a room where construction is being performed. Thus, the disposer, instead of having to take the waste material out near the street where a conventional dumpster would be located, can instead throw the waste material out the window into the flexible dumpster 2. Thirdly, the flexible dumpster 2 is very light-weight and this greatly reduces the damage done to the disposer's property caused by the weight of the conventional dumpsters. The traditional step of delivering and dropping off large, bulky dumpsters is eliminated 90. This will increase business efficiency while decreasing expenses for waste hauling companies since the flexible dumpsters need only be picked up for disposal with no steel dumpster delivery step being required 90.

During waste loading as the flexible dumpster 2 is utilized 92, the disposer would work the sides of the flexible dumpster 2 upward relative to the amount of waste material placed therein. The flexible dumpster 2 would generally be filled to full capacity.

After the flexible dumpster 2 is filled with waste material, the disposer would then contact a waste disposal company for pickup 93. The waste disposal company would then dispatch a waste removal vehicle 94 loaded with a truck-mounted forklift and forklift attachment 95 to retrieve the flexible dumpster or dumpsters. When the driver of the waste removal vehicle arrives at the disposal site, the driver would climb into the truck-mounted forklift and lower it from the truck. The driver would then drive the forklift 1 to the placement site of the filled flexible dumpster 2 as the use of the large hauling truck is bypassed 98.

During the vehicle and attachment utilization step 96, after arrival at the placement site, the driver causes the forks 15 to move in a direction opposite each other into their open position. Then the driver assures that the truck-mounted forklift 1 is in proper position to lift the flexible dumpster. Next, the driver causes the pivotable forks 15 to return to a partially closed position, thereby rotationally engaging 97 the flexible dumpster 2 with the forks 15. The flexible dumpster is then carried back to the waste disposal vehicle and loaded via the truck-mounted forklift. The driver then reattaches the truck-mounted forklift to the truck and either picks up additional dumpsters or drives to the waste landfill for disposal. At the landfill, the flexible dumpster is unloaded either utilizing the truck-mounted forklift 10 or alternatively the truck bed will dump the flexible dumpsters into the landfill.

The entire flexible dumpster can then be disposed of at the landfill 99. Alternatively, the flexible dumpsters can also be recyclable. In this situation, the contents of each dumpster would be individually dumped into the landfill.

This invention can be utilized on a conventional forklift as well as a truck-mounted forklift. Further, as explained above, the forklift attachment can be integral to a conventional or truck-mounted forklift and not manufactured as an attachment. Nothing in this description is meant to limit the forklift attachment's use to only a truck-mounted forklift. For example, the forklift attachment 10 would be useful in the industrial setting where a company would have a conventional forklift 1 on site. The forklift attachment 10 would perform in the same manner as explained above with reference to the truck-mounted forklift. However, in an industrial setting or other setting where a conventional forklift 1 is on site, the waste disposal vehicle would not be required to transport the forklift to the pick up site. In this industrial setting the forklift attachment 10 could be used to move products in addition to waste.

We claim:

1. A forklift attachment, comprising:

a pair of forks, each said fork having an upper portion and a lower portion;

a fork plate having upper corners and lower corners and having defined therein a pair of upper bores and a pair of lower bores radially defined proximate to said lower corners;

a mounting plate connected to said fork plate defining an attachment interior;

a pair of pivot pins, each said pivot pins having a center axis normal to said fork plate and rotatably connecting tops of said upper portions of said fork to said fork plate;

a pair of lower bore pins each connecting bottoms of said upper portions of said forks to said fork plate and adapted to travel within one of said lower bores;

a pair of upper bore pins connecting said upper portions of said forks to said fork plate, each said upper bore pin adapted to travel within one of said upper bores; and, a pair of actuators, each said actuator positioned behind said fork plate within said attachment interior having one end attached near one of said upper corners and another end attached to one of said upper bore pins, wherein upon actuation of said actuators, each said upper bore pin can travel within one of said upper bores thereby rotating said forks about said center axis such that said forks can apply opposing lateral compression forces to a flexible dumpster.

2. The forklift attachment of claim 1, wherein said actuator further comprises:

a cylinder housing having a housing top and a housing bottom, wherein said housing top is mounted behind said upper corner of said fork plate;

a cylinder situated within said cylinder housing;

a shaft movable within said cylinder having an upper end and a lower end distal from said cylinder; and a shaft eye formed on aid lower end adapted to allow said shaft to be connected to said upper bore pin.

3. The forklift attachment of claim 2, further comprising a longitudinal sleeve positioned to retain said shaft eye in place on said upper bore pin.

4. The forklift attachment of claim 1, further comprising a vehicle plate connected to said mounting plate adapted to allow said forklift attachment to be attached to said forklift.

5. The forklift attachment of claim 1, further comprising a support plate tab formed on said mounting plate within said attachment interior; and, a support plate situated over said support plate tab connecting said fork plate to said mounting plate.

6. The forklift attachment of claim 1, wherein said lower portions of said forks are angled.

7. The forklift attachment of claim 1, further comprising one or more shoulder bolts connecting said fork plate to said mounting plate.

8. The forklift attachment of claim 1, further comprising a face plate connected to said mounting plate against which each said upper bore pin rides.

9. A forklift attachment, comprising:

a fork having an upper portion and a lower portion;

a fork plate having upper corners and lower corners, said fork plate having defined herein a pair of upper bores and a pair of lower bores radially defined proximate to said lower corners;

a lower bore pin connecting said fork to said fork plate and adapted to travel within one of said lower bores;

a pair of upper bore pins connecting said upper portion of said fork to said fork plate, each said upper bore in adapted to travel within said upper bore;

a mounting plate connected to said fork plate defining an attachment interior;

a pivot pin having a center axis normal to said fork plate and rotatably connecting said upper portion of said fork to said fork plate;

an actuator positioned behind said fork plate within said attachment interior, said actuator further comprising a cylinder housing having a housing top and a housing bottom, wherein said housing top is mounted behind said upper corner of said fork plate;

a cylinder situated within said cylinder housing;

a shaft movable within said cylinder having an upper end and a lower end distal from said cylinder; and a shaft eye formed on said lower end.

10. The forklift attachment claim 9, further comprising a vehicle plate connected to said mounting plate adapted to allow said forklift attachment to be attached to said forklift.

11. The forklift attachment of claim 9, further comprising a support plate tab formed on said mounting plate within said attachment interior; and, a support plate situated over said support plate tab connecting said fork plate to said mounting plate.

12. The forklift attachment of claim 9, wherein said lower portions of said forks are angled.

13. The forklift attachment of claim 9, further comprising one or more shoulder bolts connecting said fork plate to said mounting plate.

14. The forklift attachment of claim 9, further comprising a face plate connected to said mounting plate.

15. The forklift attachment of claim 9, further comprising a longitudinal sleeve positioned to retain said shaft eye in place on said upper bore pin.

* * * * *